US007832682B2

(12) United States Patent
Keller et al.

(10) Patent No.: US 7,832,682 B2
(45) Date of Patent: Nov. 16, 2010

(54) METHOD AND DEVICE FOR ORIENTING A MATERIAL ROLL PRIOR TO AXIAL ALIGNMENT IN A ROLL CHANGER

(75) Inventors: Martin Richard Keller, Karlstadt (DE); Erwin Paul Josef Lehrieder, Gaukönigshofen (DE); Walter Ritter, Grünsfeld (DE); Klaus Walter Röder, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 258 days.

(21) Appl. No.: 11/922,585

(22) PCT Filed: May 17, 2006

(86) PCT No.: PCT/EP2006/062363

§ 371 (c)(1),
(2), (4) Date: Dec. 20, 2007

(87) PCT Pub. No.: WO2007/006600

PCT Pub. Date: Jan. 18, 2007

(65) Prior Publication Data

US 2009/0116948 A1 May 7, 2009

(30) Foreign Application Priority Data

Jul. 13, 2005 (DE) ..... 10 2005 032 600

(51) Int. Cl.
*B65H 16/06* (2006.01)

(52) U.S. Cl. ..... 242/599.1; 242/599.2; 242/599.3; 242/599.4

(58) Field of Classification Search ..... 242/559, 242/559.1–599.4, 534
See application file for complete search history.

(56) References Cited

U.S. PATENT DOCUMENTS 4,131,206 A 12/1978 Kawada et al.

(Continued)

FOREIGN PATENT DOCUMENTS

DE 76 22 026.3 11/1984

(Continued)

*Primary Examiner*—Sang Kim
(74) *Attorney, Agent, or Firm*—Jones, Tullar & Cooper, P.C.

(57) ABSTRACT

A material roll is transported to a roll changer by being arranged on a transport carriage. The material roll and transport carriage are placed on a transfer table which is moved into position between journal bearings of the roll changer. The transfer table is adapted to move the material roll transversely and along a longitudinal axis of the material roll and can pivot in a horizontal plane. An inclined position of the material roll, arranged on the transfer table, is determined by sensors. In this determined, axially aligned position, the material roll is axially aligned on the bearing journals. The roll size of the material is determined. An axially aligned position for roller support arms of a roll carrier of the roll changer is determined as a function of the determined roll size. An axially aligned position of the transfer table is determined as a function of the determined roll size and the determined inclined position of the material roll. The position of both ends of the sleeve of the material roll, upon insertion of the transfer table into the roll changer, is detected. The material roll is then inclined by a rotary drive which is arranged on the transfer table.

47 Claims, 9 Drawing Sheets

U.S. PATENT DOCUMENTS

| | | | | | |
|---|---|---|---|---|---|
| 5,755,395 | A | | 5/1998 | Gnan | |
| 6,007,017 | A | * | 12/1999 | Vorwerk | 242/563 |
| 6,176,670 | B1 | * | 1/2001 | Salsburg | 414/391 |
| 6,328,249 | B1 | * | 12/2001 | Ogawa et al. | 242/559.2 |
| 6,877,438 | B2 | | 4/2005 | Olbort | |
| 2004/0113010 | A1 | * | 6/2004 | Furrer | 242/559.4 |

FOREIGN PATENT DOCUMENTS

| | | | | | |
|---|---|---|---|---|---|
| DE | 37 31 488 | | | | 3/1988 |
| DE | 38 22 572 | A1 | | | 2/1990 |
| DE | 38 22 572 | C2 | | | 2/1990 |
| DE | 94 14 677.2 | | | | 2/1995 |
| DE | 43 34 582 | | | | 4/1995 |
| DE | 198 16 441 | | | | 11/1999 |
| EP | 0 227 887 | | | | 8/1986 |
| EP | 0 391 061 | | | | 2/1990 |
| GB | 2 195 322 | | | | 4/1988 |
| JP | 01075342 | A | * | | 3/1989 |
| JP | 01267242 | A | * | | 10/1989 |
| JP | 04341444 | A | * | | 11/1992 |
| WO | WO 89/08598 | | | | 9/1989 |
| WO | WO 01/86068 | | | | 11/2001 |

* cited by examiner

Fig. 7 a
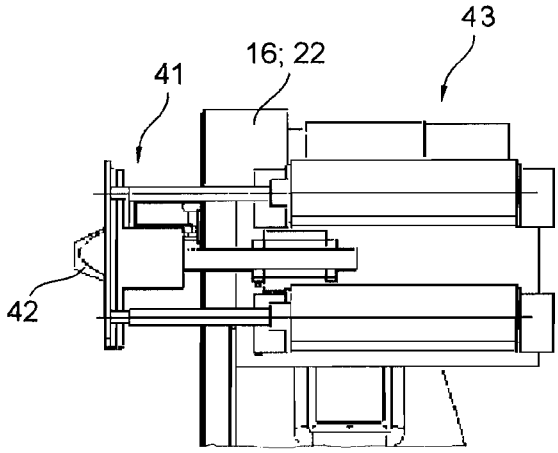
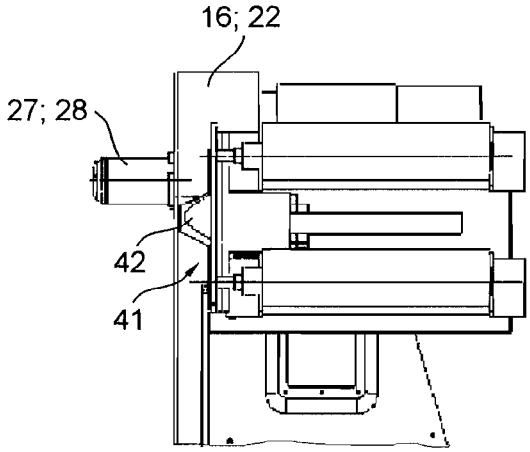
Fig. 7 b
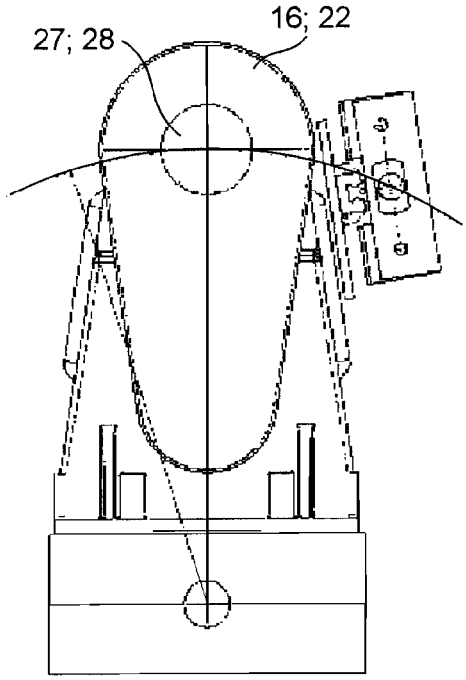
Fig. 7 c

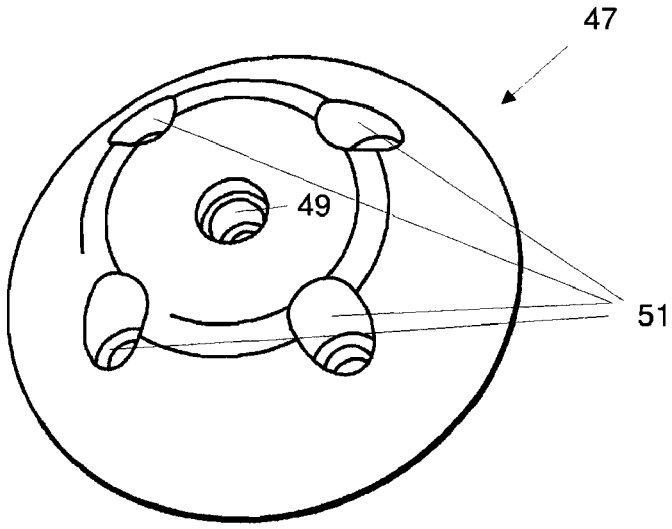
Fig. 10a
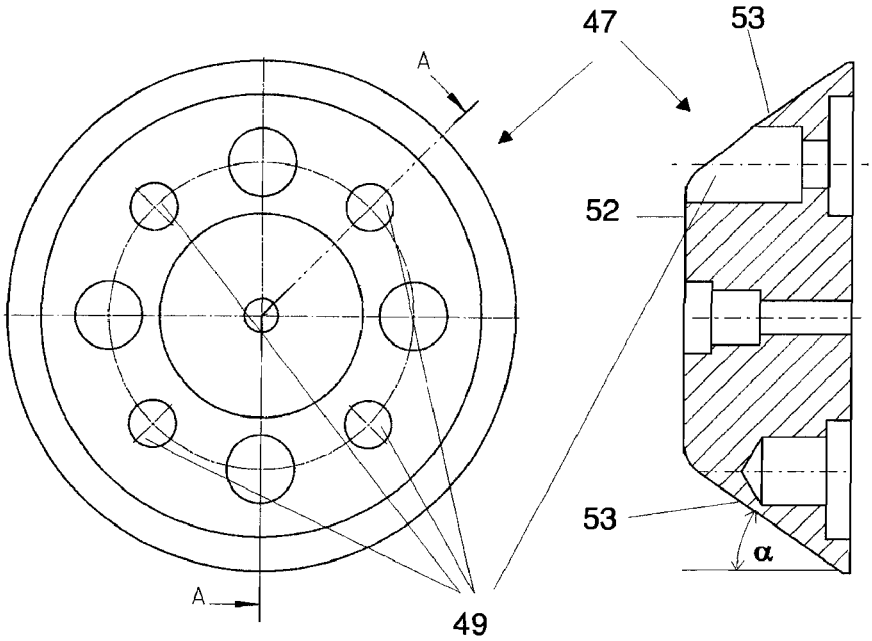
Fig. 10b
Fig. 10c

METHOD AND DEVICE FOR ORIENTING A MATERIAL ROLL PRIOR TO AXIAL ALIGNMENT IN A ROLL CHANGER

CROSS-REFERENCE TO RELATED APPLICATIONS

This patent application is the U.S. national phase, under 35 USC 371, of PCT/EP2006/062363, filed May 17, 2006; published as WO 2007/006600 A1 on Jan. 18, 2007 and claiming priority to DE 10 2005 032 600.5, filed Jul. 13, 2005, the disclosures of which are expressly incorporated herein by reference.

FIELD OF THE INVENTION

The present invention is directed to methods and to a device for orienting a material roll to be transported to a roll changer. The material roll, that is positioned on a roll transport structure or roll carriage, is oriented on a transport carriage both of which form a transfer table which can be moved into position between bearing journals of the roll changer. The transport carriage is arranged as part of the transfer table, which transfer table is capable of moving the material roll transversely and along a longitudinal axis of the material roll, and of pivoting within a horizontal plane.

BACKGROUND OF THE INVENTION

A station for loading a roll changer is known from EP 0 227 887 A2, in which a material roll is moved on a transport structure into position between roll support arms having clamping jaws, where it is raised by the transport structure. Various sensors are used for transverse centering and to detect the alignment of the roll axis and the center axis of the clamping jaws, and to register and to control the advancement of the transport structure in a horizontal direction.

EP 03 91 061 A1 describes a system for loading a roll changer. A material roll is first placed in a rough adjustment position, and then is placed in a fine adjustment position, separately from the roll changer. The fine adjustment position corresponds to the position of the loading cones in the roll changer. In this fine adjustment position, the material roll is held in place on a transport structure, and is then moved into the roll changer in a horizontal direction, by use of the transport structure.

DE 37 31 488 A1 relates to a device for clamping a replacement web of material. Various sensors ensure a precise positioning of the rolls below the clamping point. Sensors also determine the diameter of the replacement roll, from which diameter determination the sensors then determine the necessary clamping height. If necessary, the roll of material is raised to the necessary height by the use of a lifting device. The roll core is detected by a photoelectric sensor, and additional sensors detect the position of the roll when it reaches the roll changer.

DE 38 22 572 C2 describes a roll unwinding device for wound rolls of web-type material. The device enables the utilization of an automatic process for orienting the wound roll, taking into account the actual position of the core ends, without requiring the provision of a separate measuring station.

In U.S. Pat. No. 4,131,206 A, an automatic device for supplying a roll of material in a rotary printing press is described. Through the use of a dual-truck mechanism, a new roll of material is transported to the printing press, where it is clamped in the roll support via automatic positioning, and the empty core is removed. Sensors determine the parameters and the position of the roll, and enable an automatic removal of the empty core from the axle.

WO 89/08598 A1 shows a device for orienting a material roll prior to loading the roll on the axle in a roll changer. A transfer table is arranged with a transport carriage that can be moved thereon. The table can be moved transversely to a longitudinal axis of the material roll, between two bearing journals of the roll changer. The transfer table is arranged so as to transport the material roll into position between two bearing journals of the roll changer. The transfer table enables a displacement of the material roll along its longitudinal axis and a pivoting of the material roll around its longitudinal axis. Elements for detecting the position of the material roll are provided. The position detection devices are arranged so as to detect an oblique position of the material roll arranged on the transfer table.

DE 43 34 582 A1 discloses a roll changer, whose bearing arms and transfer table are positioned based upon a determined roll size.

Problems arise when the position of the roll, that has been pre-adjusted in this manner, is altered by external forces with the transfer table as it is being moved into the roll changer, or when, as a result of winding errors on the core, the pre-positioning cannot be precisely guaranteed. Especially in the case of large roll widths, this roll position alteration frequently leads to problems in loading of the roll onto the axle of the roll changer. In addition, these wide rolls are subject to other dimensional tolerances, thus making a precise positioning of the roll, during loading of the roll onto the axle, even more important.

SUMMARY OF THE INVENTION

The object of the present invention is therefore directed to the devising of methods, and to the provision of a device for orienting a roll of material to be transported to a roll changer.

The object is attained according to the present invention with the provision of the material roll being transported to the roll changer positioned on a transport carriage which is, in turn, part of a transfer table. The transfer table is moved into position between bearing journals of the roll changer. The transport carriage is arranged as part of the transfer table which is capable of moving the material roll transversely and along a longitudinal axis of the material roll, and of pivoting the material roll within a horizontal plane. Sensors are used to determine the size of the roll and its oblique positioning on the transfer table. The positions of the two roll core end surfaces are determined, as the transfer table is moved into the roll changer. The material roll is then loaded on the roll changer.

The benefits to be achieved in accordance with the present invention consist especially in that, without additional process steps, the material roll can be positioned correctly in the roll changer for automatic placement on the axle of the roll changer.

A roll of material is moved into the roll changer with the use of a transfer table. The roll of material can be pivoted on its longitudinal axis on the transfer table as it is being moved by the transfer table.

This movement of the roll of material can be accomplished, for example, by the use of a rotating mechanism, which is integrated on the transfer table and which pivots the material roll around a vertical axis. If necessary, an additional lifting device, which is also on the transfer table, can raise or lower the material roll at one end or at both ends. This corresponds to a pivoting of the material roll on a horizontal axis, transversely to the longitudinal axis of the roll. With the pivoting, the roll of material can be aligned precisely to the bearing journals of a roll changer, which bearing journals will engage in the core of the roll.

A variety of options for positioning the material roll using such a transfer table exist, and will be specified in the discussion which follows.

A first option is for the material roll to be first moved on a roll carriage, such as, for example, a roll carriage that is rail-mounted, in a transfer table track. The roll carriage, with the material roll, is first positioned centered in the longitudinal direction on the transfer table. To this end, the transfer table is moved transversely to the longitudinal axis of the roll, in the direction of the roll changer, up to a measuring position. One or more measuring devices are mounted on the roll changer. These measuring devices measure a distance from the end surface of a new material roll to a fixed point, which measured distance especially occurs in the outer area of the roll and in the vicinity of the core. To this end, distance sensors are preferably positioned on the roll support arms as a part of a measuring device. These distance sensors determine the position of the core and the outside edge of the material roll at both ends of the material roll. The material roll is then moved, with the transfer table, into a position for loading the material roll onto the axle of the roll changer, that position having been determined from the measured values provided by the sensors. This axle-loading position corresponds to a theoretically optimal position for the material roll, with a parallel axial orientation, between the longitudinal axis of the material roll and the rotational axis of the bearing journals.

In the next step, the longitudinal axis of the core of the material roll is oriented through the operation of the rotational device and, if necessary, the lifting device. During this step, corresponding sensors supply measured values to the corresponding control devices. Loading of the material onto the axle is then implemented, through an axial movement of the bearing journals of the roll changer toward the center of the material roll. The transfer table is then moved back to its starting position, if applicable, after the transfer table or the lifting device has been lowered or the material roll has been raised with the help of the roll support arms.

Another option for roll positioning includes first determining the diameter of the roll of material on the transfer table, and from this, determining values for the axle-loading position for both the roll support arm and the material roll. The roll support arm and the transfer table are then moved into this position. Sensors on the roll support arm determine the actual position of the core and, based upon the deviation of that actual position from the optimum axle-loading position, the rotational device and/or, if necessary, also the lifting device is actuated until the axle-loading position is actually reached. After the roll has been loaded onto the axle, the transfer table is returned to its starting position.

A simpler solution would involve the use of a transfer table without the inclusion of a lifting device. In this case, as in the aforementioned variation, the transfer table is first moved into the axle-loading position, and the rotary drive is switched to free-running operation. The material roll is then rotated, during the axle-loading process, by the freely movable rotating device, as the first bearing journal is being moved into position, in such a way that the axis of the core is aligned coaxially to the axis of the bearing journal, and the second bearing journal is now able to move into position in the core. This embodiment can also be configured as a manual embodiment, in which the track on the transfer table is secured against rotation, and can be released manually as needed.

In one preferred embodiment of the present invention, after the aligned loading of the material roll onto the axle of the roll changer, parts of the loading device are also used to align the edges of the expiring material web and of the new material web. In this embodiment operation, not only is the position of an edge of the new material web detected, but a distance between the end surface of the new material roll and a fixed point is also detected. The roll positioning sensor is preferably used for this. With this procedure, the independent displacement of a distance sensor can be dispensed with.

The measuring device in accordance with the present invention is preferably an optical position sensing system, which permits contactless measurement. With modified embodiments, however, other measurement systems, such as, for example, radar systems, acoustic sensors or interferometric sensors, can also be used.

The measuring device is preferably mounted on a roll support arm of a roll changer. The advantage of providing the measuring device on the roll support arm is that only short measuring distances are necessary, which short measuring distances can be maintained, even with variable roll widths. In these cases, the respective sensor is moved along with the roll support arm, so that it always maintains a small distance from the material roll. Alternatively, the measuring device can be provided rigidly situated at the side of the roll changer frame. This is particularly beneficial when movable sensors are to be dispensed with.

In one preferred embodiment, the distance is measured at the end surface of the roll near the uppermost layer of paper, as the roll is being moved into the roll changer. To accomplish this result, the measuring device can also be positioned so as to be displaceable perpendicular to the roll axis. A displacement of the measuring device, in a radial direction, could also be coupled with a sensor for use in detecting a diameter of the new material roll. The necessary radial position of the sensor can then be automatically determined and adjusted.

As a desired value, a distance from an end surface of the roll to a relative fixed point in the roll changer, such as, for example, the roll support arm, which distance is desired under normal conditions, is determined. The desired value and the actual value must both relate to the same relative fixed point.

If the actual, measured value is the same as the desired value, the roll support arms of the expiring material roll and the new material roll are aligned with one another, at least in the case in which the width of the new material web is the same as that of the expiring material web. If the actual value differs from the desired value, the clamped new material roll is displaced in an axial direction by the amount of that deviation, by the use of a positioning drive. In any case, the positioning drive is provided on each roll support for lateral edge control during operation, so that no additional drive elements are necessary. With this, in the case of winding errors, and although, at the time the roll is changed, the two roll supports are no longer precisely aligned with one another, an edge offset between the material webs during gluing is prevented or at least is minimized.

Another option for orienting the material roll coaxially consists in also using distance sensors to measure the distance of a pivoting axis, from the outside of the roll, to both ends of the material roll. In this variation, variant, the material roll can be moved into the roll changer. If the distance measurement of the two end points of the roll results in a difference, the material roll is not aligned in parallel, and the rotary drive must be actuated. The rotary drive is decelerated when two equal measured values are reached, as determined by the distance sensors. Based upon the known roll diameter, the material roll can then be displaced parallel with the transfer table, until the axle-loading position is reached.

One option that is inexpensive, because complicated sensors and control systems are dispensed with, involves the use of touch sensors or of spring-mounted stops to align the material roll. To this end, in one preferred embodiment touch sensors can be provided on the ends of the roll support arms. The roll support arms are first moved into a closely spaced position, so that the material roll will not fit between them. The transfer table is initially shifted slowly in the direction of the roll changer. If the material roll lies in an oblique position, the touch sensor is actuated on the leading side of the roll, which activation of the touch sensor engages the rotary drive. Once the material roll is oriented in parallel with the roll supports, the touch sensor on the second support arm is actuated, which switches off the rotary drive and the displacement of the transfer table. A brake is also engaged, as needed. With lighter-weight material rolls, the torsional drive can also remain switched off, in which case, when the first touch sensor is reached, the torsional drive is momentarily switched on and, when the second touch sensor is actuated, is stopped again. Following adjustment of the roll support arms, the oriented material roll can be moved into the axle-loading position and then loaded onto the axle.

BRIEF DESCRIPTION OF THE DRAWINGS

Preferred embodiments of the present invention are represented in the set of drawings, and will be specified in greater detail in what follows.

The drawings show in:

FIG. 1*a*) a side elevation view of a transfer table; in

FIG. 1*b*) a top plan view of a transfer table; in

FIG. 3 a top plan view of the roll changer according to FIG. 2; in

FIG. 4 a top plan view of a second positioning device in a roll changer; in

FIG. 5 a top plan view of a third positioning device; in

in FIG. 7 views of a further preferred embodiment of a device for positioning a material roll in accordance with the present invention.

DESCRIPTION OF THE PREFERRED EMBODIMENTS

Figures 1A, 1B:
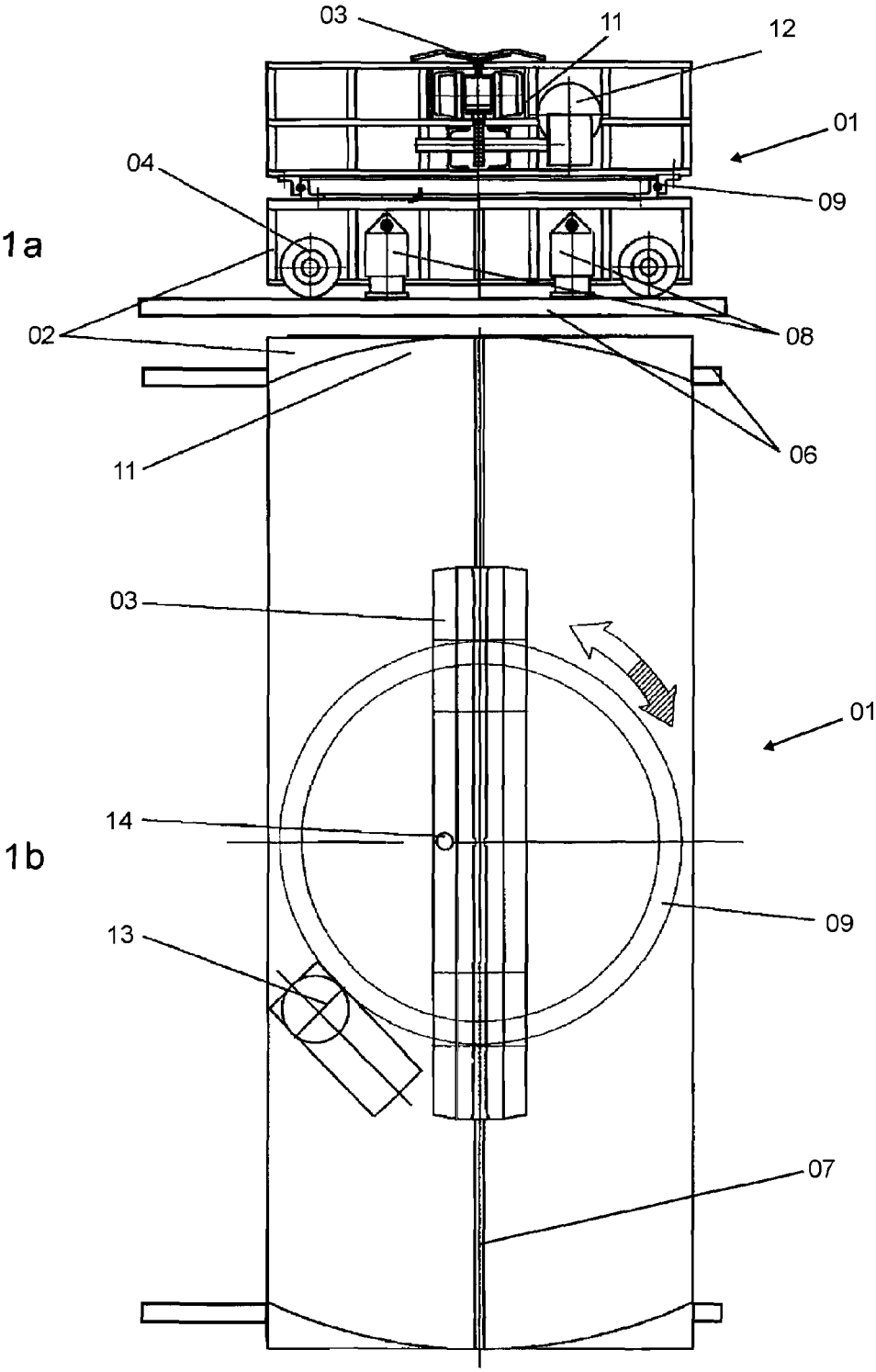

Referring initially to FIG. 1, there is shown a transfer table 01, which is configured to perform a process in accordance with the present invention. FIG. 1 *a*) shows a side view of the transfer table 01 and FIG. 1 *b*) shows a top plan view of the transfer table. The transfer table 01 is essentially divided into two parts, and consists of a transport carriage 02 and a roll transport structure 03 configured as a part of the transport carriage 02 of the transfer table 01. The transport carriage 02 can preferably be moved on wheels 04 on tracks 06, which are also shown, for example, in FIG. 2, transversely to a longitudinal axis 07 of a roll to be transported. Additionally, a lifting device 08 can be provided as part of the transport carriage 02, with which the height of the transfer table 01 can be adjusted on one side or on both sides. The lifting device 08 can preferably be supported on the tracks 06. The lifting device 08 can be, for example, a correcting element 08, such as an actuator cylinder 08, and especially can be configured as a hydraulic piston 08 or as a pneumatic piston 08.

A bearing ring 09 is provided on the transport carriage 02, and which accommodates a transport rail 11 for the roll transport structure 03 and for its drive 12, rotatably mounted thereon. A rotary movement of the bearing ring 09 is achieved through the use of a preferably electromotive bearing ring rotary drive 13, which is preferably equipped with a planetary gear system, and which has an angular sensor that is not specifically shown in FIG. 1. In addition, a return of the bearing ring 09 to its starting position can be implemented via springs and/or by use of the rotary drive 13. The bearing ring 09 is configured in the form of a rolling-contact bearing. The bearing ring 09 preferably has a circular shape and thus is preferably configured as a 360° closed ring. The rotational movement of the bearing ring 09 amounts to at least +/−10°, preferably amounts to +/−15°, but can also amount to 360° or more. The margin or end face surfaces of the rail 11 on the bearing ring 09 is rounded at the end surfaces at the transfer points and adjacent the tracks 06, which are embedded in concrete, so that the rail 11 will not collide with the concrete edges during rotation.

The roll transport structure 03 can be centered in the longitudinal direction of the transport rail 11 by the provision of an initiator 14. The initiator 14 can be implemented, for example, as a photoelectric sensor, which stops the drive 12 for the roll transport structure when the center position is reached. A simple stop would also be an option in this case.

In a simpler embodiment of the transfer table of the present invention, the lifting device 08, including the hydraulic pistons 08, can also be dispensed with.

Figure 2:
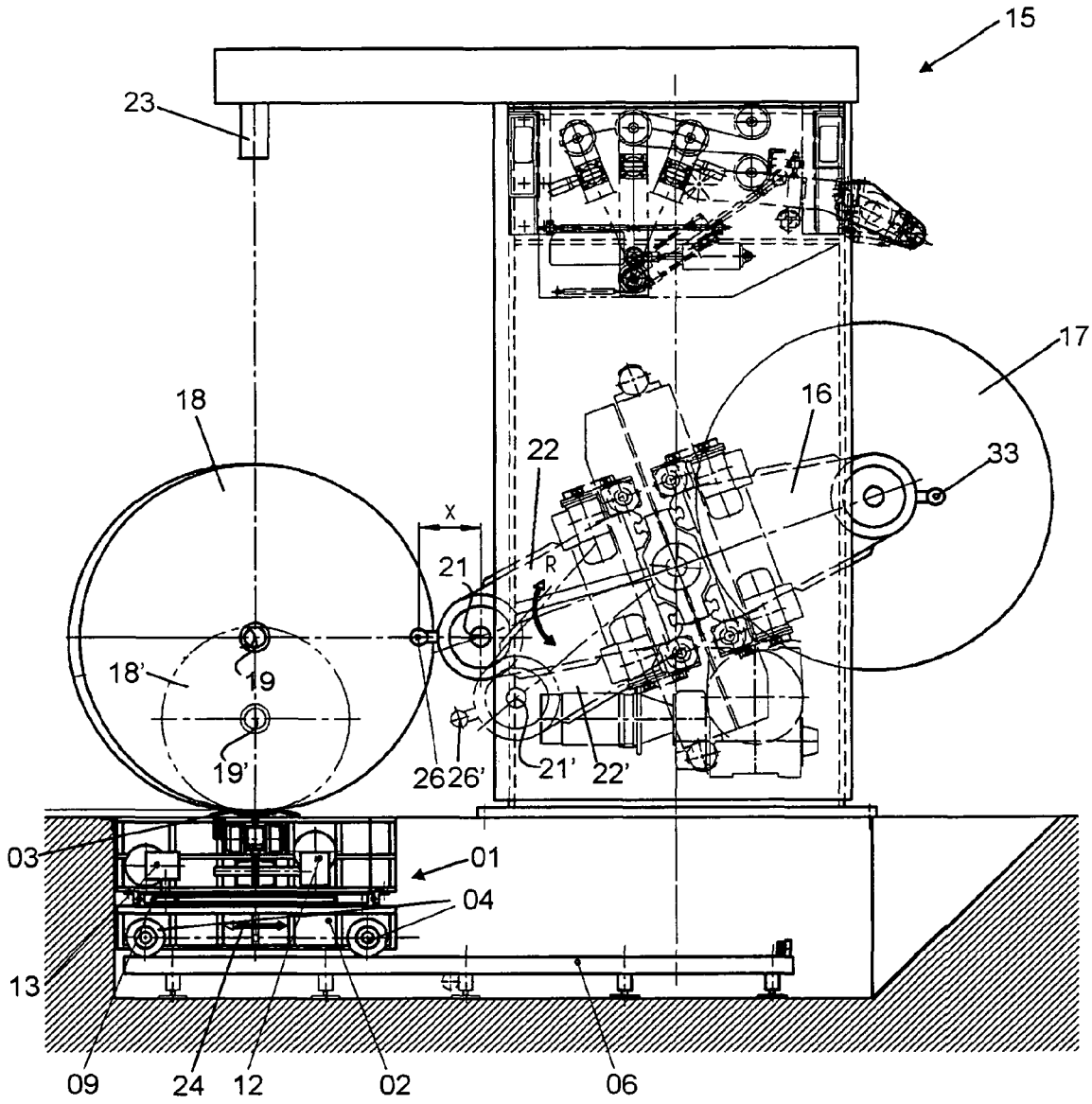
FIG. 2 a side elevation view of a roll changer with a transfer table and a first positioning device, in a first embodiment of the present invention.

FIG. 2 shows a side view of a roll changer 15 with a transfer table 01 for implementing a process for orienting a roll of material in accordance with the present invention. On a first roll support, which is comprised of two axially spaced roll support arms 16 lying one in front of another, in the plane of FIG. 2, an expiring roll of material 17 is clamped between bearing journals. A new material roll 18 has been transported, in advance, to the roll changer 15 and is transferred to the roll changer 15 via the roll transport structure 03. The new material roll 18 is in a stand-by position in front of the roll changer 15, as is depicted in FIG. 2. In this standby position, it can be the situation that the longitudinal axis 19 of the new material roll 18 is not yet aligned parallel to the center axis 21 of the bearing journals of a second roll support, which second roll support is, in turn, comprised of two roll support arms 22 lying one in front of another in the plane of FIG. 2. The oblique position of the new material roll 18 is schematically indicated in FIG. 2 by a slightly perspective representation. A new material roll 18', and having a smaller diameter is indicated by dashed lines. Its respective longitudinal axis is labeled 19'.

In the stand-by position, which is depicted in FIG. 2, the new material roll 18 or 18' is first pre-positioned, centered between the roll support arms 22.

In the stand-by position which is shown in FIG. 2, the diameter of the new material roll 18 or 18' is determined by a sensor 23, such as, for example, a diameter sensor 23, which is preferably positioned in the frame of the roll changer 15, again as may be seen in FIG. 2. This diameter determination is accomplished by measuring a distance of the upper side of the roll 18 or 18' from the diameter sensor 23. If the overall height of the diameter sensor 23 is known, the roll diameter can be determined in this way.

However, the roll diameter can also be determined in a different manner, for example by scanning a barcode label on the new material roll 18 or 18'. From the diameter of the new material roll 18 or 18', a measuring position is determined, into which measuring position the second roll support with the roll support arms 22 is pivoted. In the depiction of FIG. 2, the roll support arms 22 are already shown in the measuring position. The roll support arm 22', which is pivoted into the measuring position for the material roll 18', which has a smaller diameter, is also indicated, in FIG. 2, by dashed lines.

As has already been specified in connection with FIG. 1, the transfer table 01 can be moved, through the use of the wheels 04 on the transport carriage, on the tracks 06, and transversely to the roll longitudinal axis 19, in the direction of the motion arrow 24, as seen in FIG. 2. The bearing ring 09 is rotatably mounted on the transfer table 01, and can be actuated via a bearing ring rotary drive 13, which is especially constituted as an electric motor 13. The roll transport structure or roll carriage 03 is mounted on the rotatable bearing ring 09, and can be moved back and forth in the image plane of FIG. 2 on the transfer table 01 via the roll transport structure drive 12.

Figure 3:
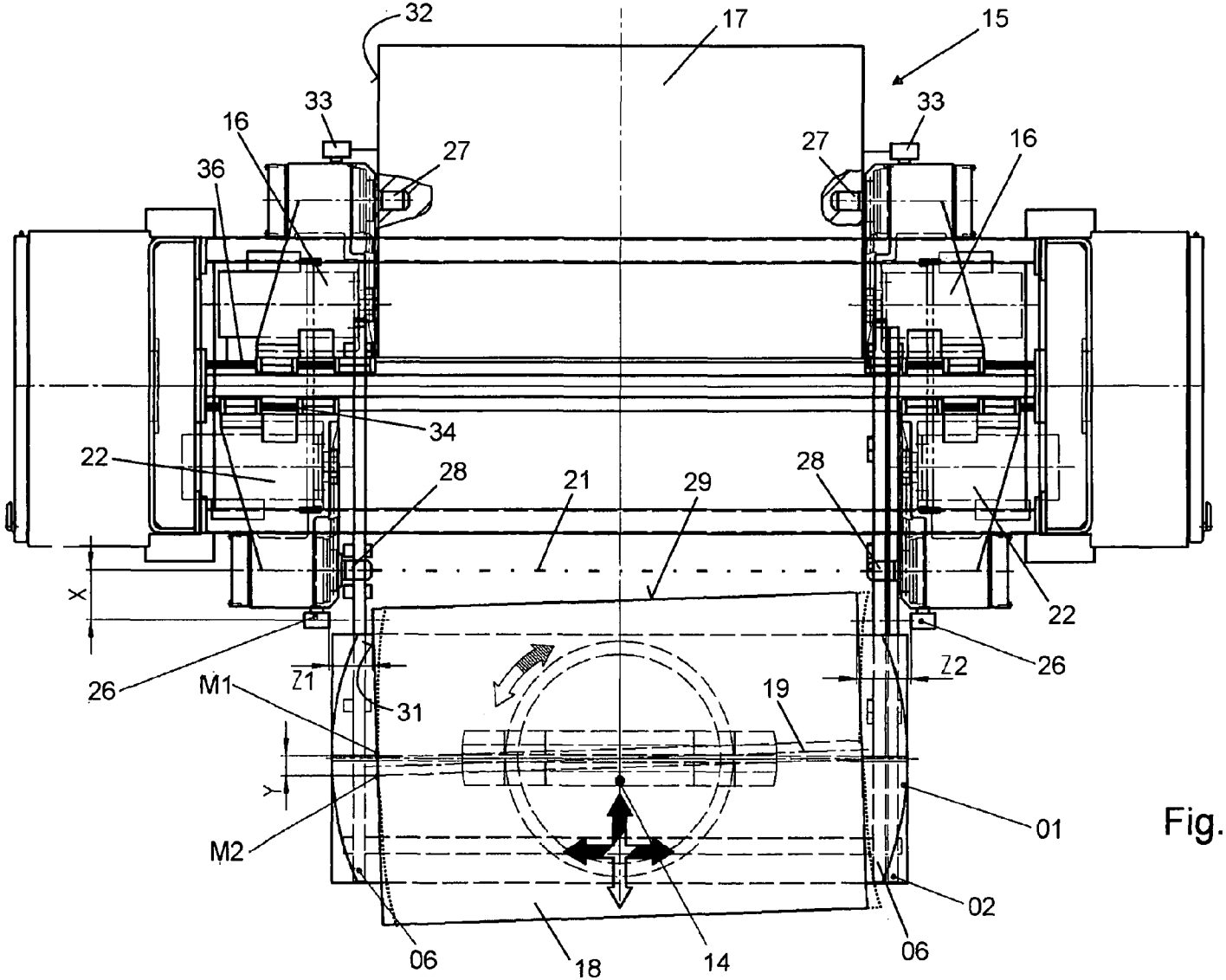

Position detection elements 26, such as, for example, first sensors 26, are attached to the roll support arms 22, preferably at their ends, which position detection sensors 26 are spaced at a defined distance "x" from the center axis 21 of the bearing journals of the roll support arms 22, as seen in FIGS. 2 and 3. The first, position detection sensors 26 are preferably positioned on the roll support arm 22 such that in a measuring position, the center axis 21 of the bearing journals, the longitudinal axis 19 of the new material roll 18, and the first sensor 26 lie within a single plane, as is shown in FIG. 2. This offers the advantage that the measuring position of the roll support arms 22 also corresponds to the loading position, and the roll support does not need to be readjusted following measurement.

In the measuring position for the material roll 18', as is indicated by the dashed lines of FIG. 2, the longitudinal axis 19' or the center axis 21' and the position of the sensor 26' do not lie within a single plane. Therefore, in this case, the roll support arm 22 does need to be pivoted again after measurement. If a lifting device 08 is provided in the transfer table 01, the material roll 18 or 18' could also be raised to achieve alignment, and a readjustment of the roll support can be dispensed with.

It is also conceivable for separate or existing sensors to be provided for the most frequently processed roll diameter, such as, for example, between 1,250 and 1,500 mm, which separate or existing sensors are attached to the roll support arm 22 in such a way that the measuring position always corresponds to the loading position, and the corresponding sensors are activated following measurement of the roll diameter.

In a preferred embodiment of the present, the further process sequence for loading a roll of material 18, 18' onto the axle will be specified, as taken in the context of FIG. 3, which shows a top plan view of the roll changer 15 of FIG. 2. The expiring material roll 17 is clamped with its roll core supported in spaced bearing journals 27, which are each respectively mounted on one of a pair of spaced roll support arms 16 of the first roll support.

The roll support arms 22 of the second roll support are in the axle-loading position, as depicted in FIGS. 2 and 3. In other words, they are spaced further from one another, in an axial direction, than they would be in the clamped position, so that the material roll 18 can be moved into position, on the transfer table 01, between the bearing journals 28 of the second roll support, as shown in FIG. 3. This positional movement is accomplished by moving the transport carriage 02 on the tracks 06 in the direction of the roll changer 15, and transversely to the longitudinal axis 19 of the material roll 18. A leading longitudinal or peripheral edge 29 of the new material roll 18 first passes the first sensors 26. In this passing, a respective distance Z1 and Z2 from each of the end surfaces 31 of the roll to the sensors 26 is measured. If Z1=Z2, in the most favorable case, the longitudinal axis 19 of the new material roll 18 is already aligned parallel with the center axis 21 of the bearing journals 28. However, if there is a winding error in the material roll 18 or if there is a core offset in the material roll 18, a further criterion must be used for the coaxial alignment of the material roll 18 with the center axis 21 of the bearing journals 28.

In this instance, wherein Z1 may not be equal to Z2, the material roll 18 is first displaced further toward the roll changer 15 at a constant speed. This is followed by a detection of the roll core, in which the sensor 26 records and stores the measuring points M1 and M2, as the core passes through a laser beam. The points M1 and M2 are detected separately at the two ends of the core portion of the material roll 18, and from these points, an axial offset "y" is determined, as depicted in FIG. 3. Naturally, other sensors that determine the core position, such as, for example, by evaluating a change in a magnetic field, as the core passes through, can also be used for this measurement.

The axial offset "y" could also be determined simply from the difference in distance between the measuring points M1 on both sides of the roll changer 15.

When an axial offset, "y"≠0, the bearing ring 09 can be rotated, by utilization of the bearing ring rotary drive 13, and the roll transport structure 03 can again be moved transversely of the roll longitudinal axis 07 until the axial offset "y" has been corrected. However, the rotary drive 13 for the bearing ring 09 can also be switched back on momentarily, and the roll support arm 22 on the side of the correct core position is caused to move first into the core. The material roll 18, which is being supported by the roll transport structure 03, with the actuated bearing ring 09, is automatically rotated, until the second side of the core is also aligned. The other roll support arm 22 can then also be moved into the core. The further axle-loading process is implemented in a generally known manner.

When the new material roll 18 is in the clamped state, each of the first, position detection sensors 26 also measures the distance to the end surface 31 of the new material roll 18 adjacent it. Because the end surface 31 does not necessarily extend parallel to the adjacent roll support arm 22 of the roll support, as is illustrated by the dotted edge line in FIG. 3, the edge distance measurement Z1 or Z2 should be performed in the outer area of the end surface 31, if at all possible, in other words near the uppermost material layer of the new material roll 18.

As the desired value for the edge alignment, a machine-based standard distance from the end surface 32 of the expiring material roll 17 to the allocated roll support arm 16, with a correct winding, can be preset. Any deviations, between the actual position of the end surface of the expiring material web and the assumed standard value are small near the center of the roll. With modified embodiments, however, the distance from the roll support arm 16 to the end surface 32 of the expiring material roll 17 can also be measured by a position-detecting element 33, a second sensor 33, in order to precisely determine the desired value for the new material roll 18.

A comparison of the actual value and the desired value provides a positional deviation. When a positional deviation exists, the clamped new material roll 18 is moved in an axial direction until a position that corresponds with the desired value is reached. In this movement, the distance between the end surface 31 of the new material roll 18 and the first sensor 26 does not change. Instead, the roll support with the material roll 18 is moved, in order to compensate for the deviation from the desired value by adjusting the position of the new material roll 18.

The new material roll 18 is displaced in an axial direction by a synchronous movement of the roll support arms 22 of the second roll support along a second motion axis 34, as seen in FIG. 3, by the use of a positioning drive. Similarly, the roll support arms 16 of the first roll support can be adjusted along a first motion axis 36, as also seen in FIG. 3, by the use of a separate, second positioning drive, in order to compensate for the existing edge offset.

The displacement of the new material roll 18, to adjust the edge position, can be performed either via a continuous measurement and movement, or via a one-time measurement, a determination of the resultant deviation and a repositioning of the new material roll 18 by the determined amount of deviation.

A second sensor 33, which corresponds to the first sensor 26, is provided respectively on each of the roll support arms 16 of the first roll support, as may be seen in FIG. 3. When the roll change has been completed, this first roll support can take on another new material roll, and the distance to the end surface of this additional new material roll is determined again.

The same process can also be used, in a similar manner, for small material rolls 18', with the exception of the now necessary, above-described, re-pivoting of the roll support arms 22.

Figure 4:
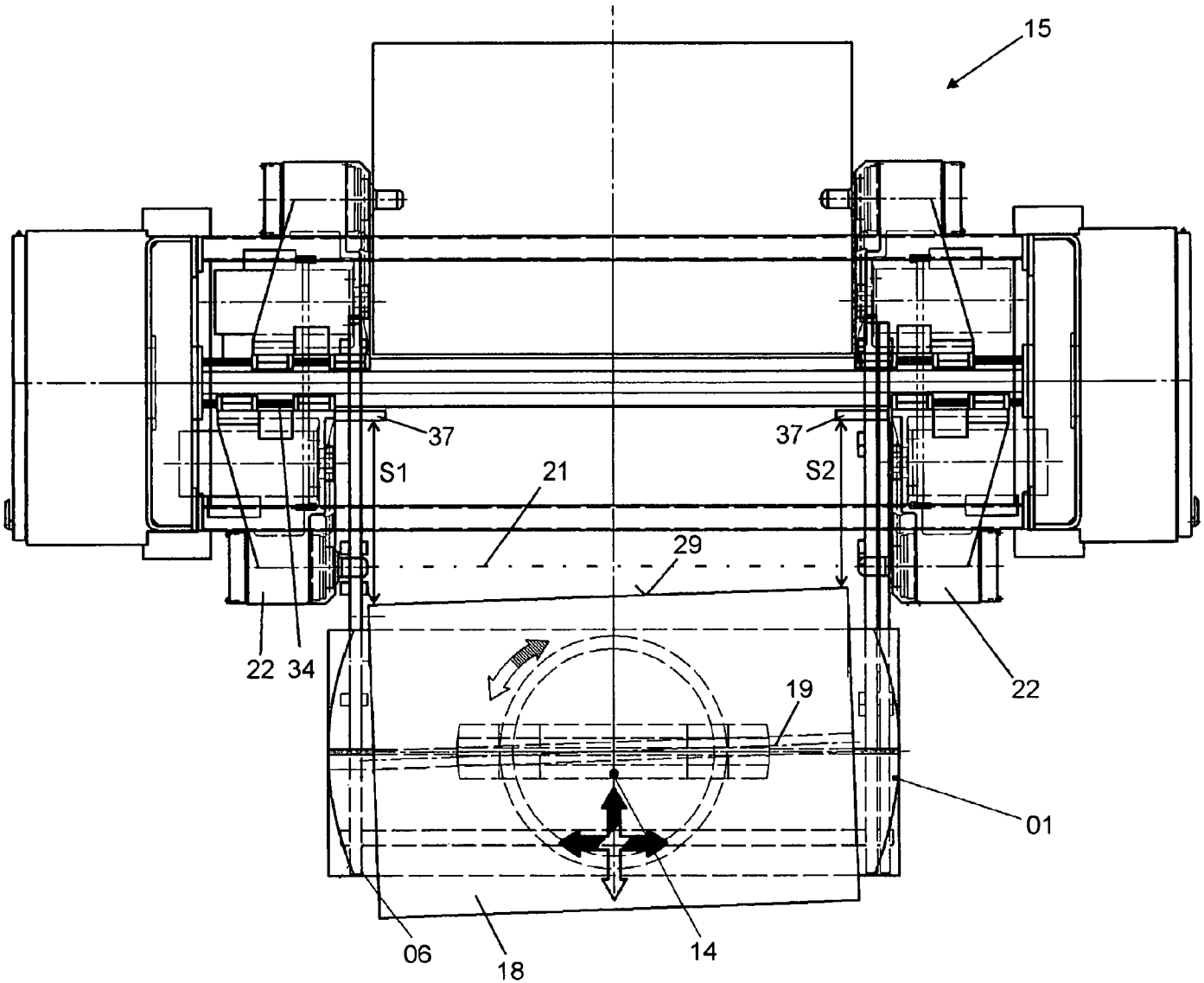

In FIG. 4, a further embodiment of a device for orienting the new material roll 18 in the roll changer 15, in accordance with the present invention, is illustrated. The overall process is similar to the process already described in connection with FIGS. 1-3. A sensor or sensors 37, such as, for example, distance sensors 37, which are preferably attached to the roll supports 22 near the second motion axis 34, measure the distances S1 and S2 from the longitudinal or peripheral edge 29 of the new material roll, as the transfer table 01 is being moved into the roll changer 15. If the measured values for S1 and S2 are unequal, the material roll 18 is rotated until the measured values are equal. Afterward, the material roll 18 is moved fully into the roll changer 15, and is loaded onto the axle.

Figure 5:
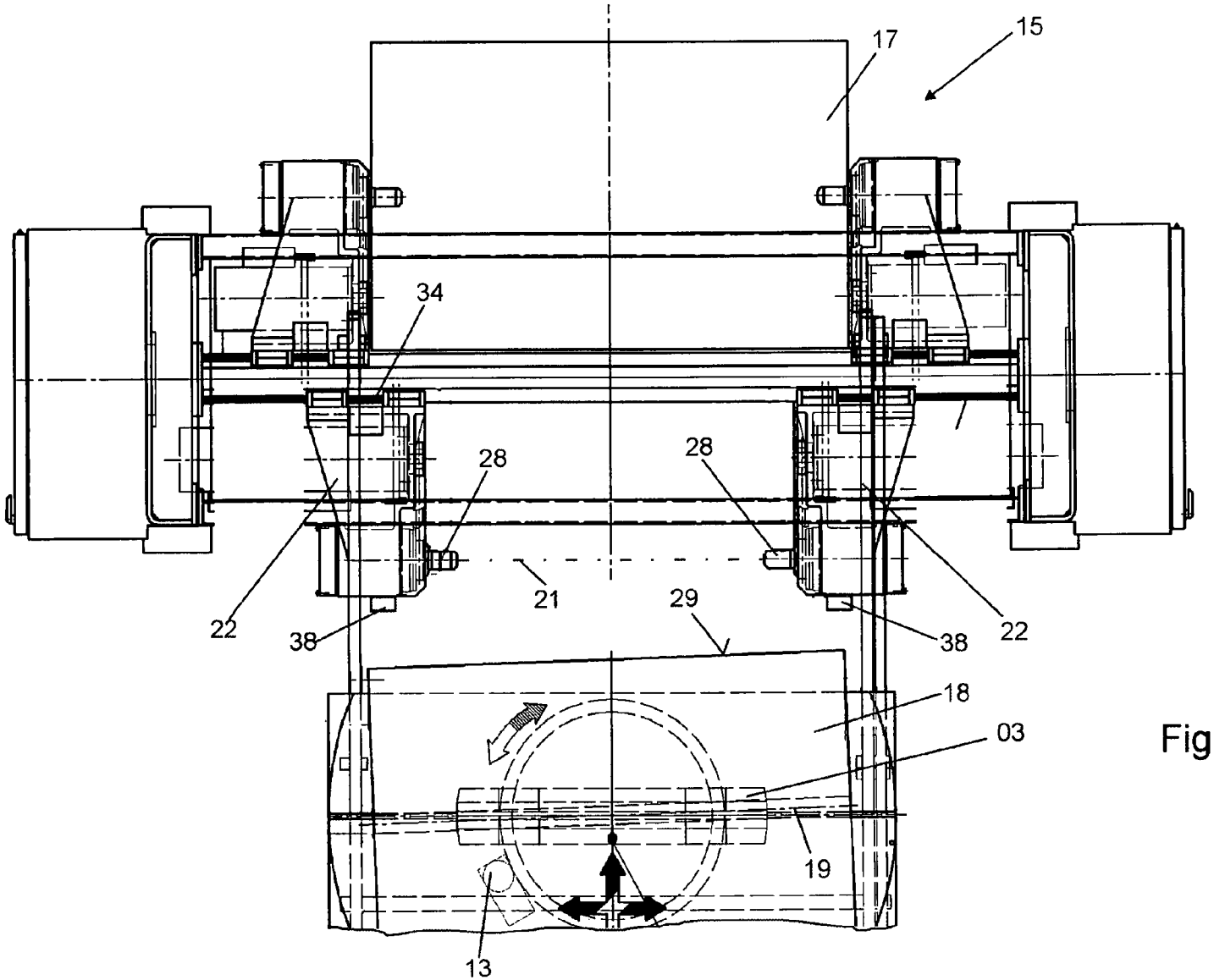

FIG. 5 shows an embodiment of the present invention, and with a sensor, or sensors 38, such as, for example, touch sensors 38, which are attached to the roll support arms 22. In this embodiment, no complicated systems for evaluating the measured values are necessary, because the alignment is implemented directly via a contact measurement. To orient the material roll 18 in this embodiment, first the roll support arms 22 are moved toward each other along the motion axis 34, so that the longitudinal or peripheral edge 29 of the new material roll 18, which is being moved in transversely to the longitudinal axis 19, is able to strike or to contact the touch sensors 38. If the material roll 18 lies obliquely to the motion axis 34, as is indicated in FIG. 5, the leading part of the longitudinal or peripheral edge 29 will first touch the touch sensor 38 shown on the right roll support arm 22. This touch sensor 38 can switch the bearing ring rotary drive 13 directly to clockwise rotation, until the other side of the material roll 18 also actuates the left touch sensor 38, which stops the bearing ring rotary drive 13. With this operation, the longitudinal axis 19 of the material roll 18 is now aligned parallel to the center axis 21 of the bearing journals 28.

An even simpler variation of the present invention can be implemented when the touch sensor 38 that is first actuated, switches the bearing ring 09 to a free-running mode of operation, and the material roll 18 is rotated and oriented on the roll transport structure 03 by virtue of the movement of the transfer table 01 in the direction toward the roll changer, as indicated by arrow 24 of FIG. 2. When the second touch sensor 38 is touched, the bearing ring 09 and thereby also the roll transport structure 03 are stopped again. The roll support arms 22 are then moved apart from each other and into the axle-loading position and the transfer table 01 can be moved into position between the bearing journals 28, where the further axle-loading process is now able to be implemented in a generally known manner.

Figure 6:
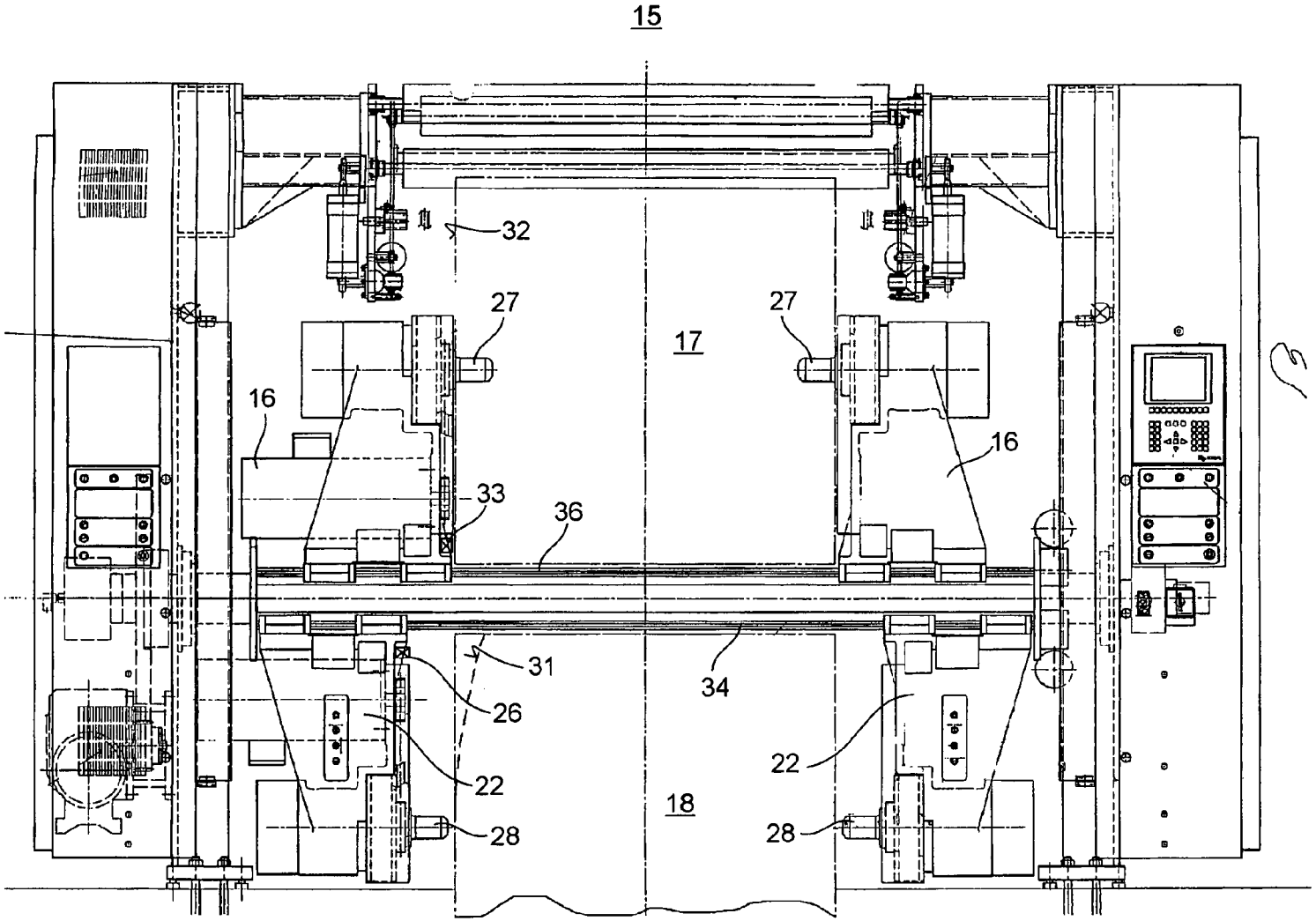
FIG. 6 a top plan view of a modified embodiment of the roll changer in accordance with the present invention.

To further illustrate the options for utilizing the sensors 26; 33, which are provided for orienting the new material roll 18 in edge alignment, in FIG. 6 the roll changer 15 is shown, again in a top plan view. The procedural for minimizing edge offset has already been specified in detail in connection with FIG. 3. The expiring material roll 17 is clamped between the roll support arms 16 of the first roll support. The new material roll 18 is in its position prior to clamping. In the clamping process, the roll support arms 22 of the second roll support are moved in respective opposing axial directions, with respect to each other, and both toward the roll center, until the bearing journals 28 become engaged in the core of the new material roll 18, which material roll core is not specifically shown here.

The first sensor 26 is preferably fastened to the roll support arm 22 of the second roll support, and can be the same sensor that is used, as described above, for alignment of the roll. With this sensor 26, in the clamped state of the new material roll 18 in the roll changer, the distance to the end surface 31 of the new material roll 18 is measured. The end surface 31 of the new material roll 18 does not necessarily extend parallel to the roll support arm 22 of the roll support, as is again indicated by the dashed edge line shown in FIG. 6.

To orient a material roll 18, which is being delivered for loading onto the axle of a roll changer 15, a device according to the following preferred embodiment can also be used, as is shown in FIG. 7:

An infeed unit 41 for a position detection element 42, and especially for an alignment element 42, such as, for example, an alignment cone 42 with a conical tip, is mounted on the roll support arms 16; 22 of the roll support. This alignment element 42 is located on the same radius as the bearing journals 27; 28.

The material roll 18 is moved with the transfer table 01 to a defined axle-loading position, as based upon the previously determined diameter of the material roll 18.

The roll support arms 16; 22 of the roll support are rotated to an aligned position, based upon the predetermined diameter of the new material roll 18, with that aligned position being defined by the axle-loading position, minus the angle offset between the bearing journals 27; 28 and the alignment cone 42. In this position, as shown in FIG. 7*a*, the alignment cone 42 is moved forward toward the core, in order to align the oblique material roll 18. The alignment cone 42 is then retracted, as seen in FIG. 7*b*, and the roll support arms 27; 28 are rotated into the axle-loading position, as depicted in FIG. 7*c*. The aligned material roll 18 can then be loaded onto the axle.

The alignment cone 42 can be moved in the infeed unit 41 by the use of at least one positioning drive 43, as shown schematically in FIG. 7*a*, such as, for example, an actuator cylinder, and especially a pneumatic cylinder, relative to the bearing journals 27; 28, and can be moved especially linearly in the direction of a longitudinal axis of the adjacent bearing journal 27; 28.

These alignment cones 42 are preferably positioned adjacent to all four bearing journals 27; 28.

Figure 8:
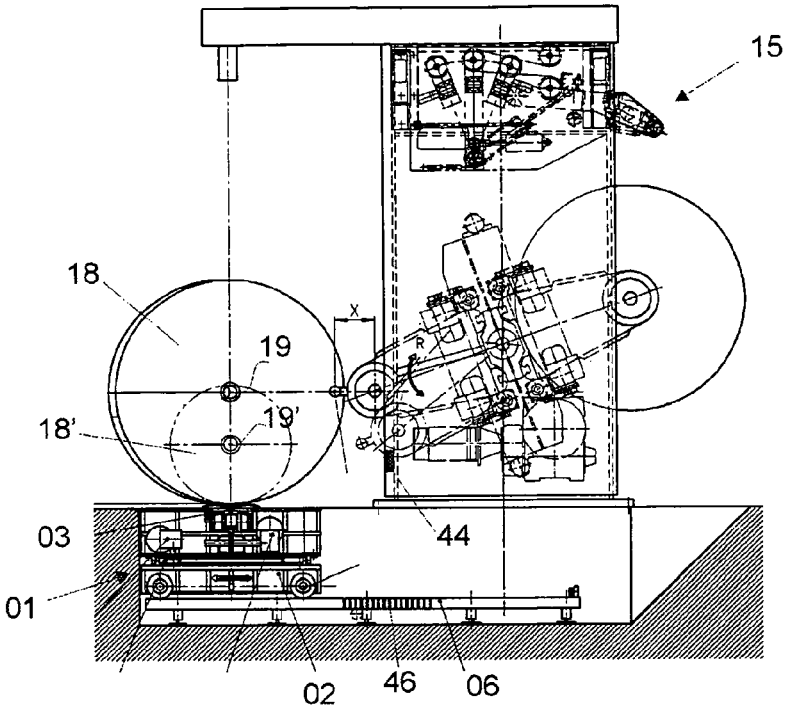
in FIG. 8 a side elevation view of a further preferred embodiment of a roll changer in accordance with the present invention and with a positioning device.
Figure 9:
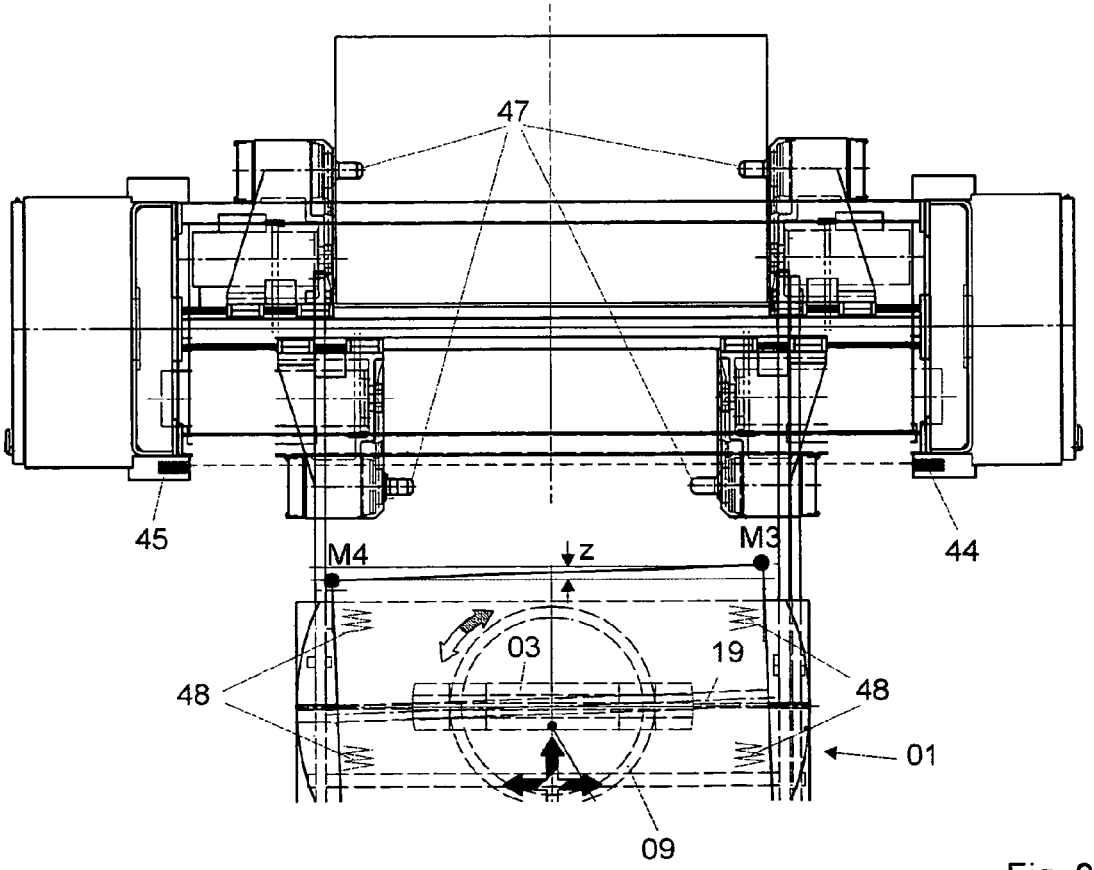
in FIG. 9 a top plan view of the embodiment according to FIG. 8; and in FIG. 10 various views of a preferred embodiment of a centering tip in accordance with the present invention.

In FIGS. 8 and 9, a further embodiment of a roll changer 15, in accordance with the present invention, is illustrated, in which embodiment the position detection elements are arranged on the side frame of the roll changer 15. In this embodiment, the position detection elements are laser sensors 44, 45, which are permanently attached to the roll changer. In connection with this embodiment, as depicted in FIGS. 8 and 9, the method for aligning the new material roll 18 or 18', which is implemented using the depicted embodiment of the present invention, is also described.

As the material roll 18 or 18' is being moved into a theoretical axle-loading position in the roll changer 15, the edge of the material roll 18 or 18', that is moving forward rapidly in the transport direction, is detected by the laser sensors 44, 45. The theoretical axle-loading position for the transfer table is the position in which the material roll 18 or 18' is aligned coaxially with the rotational axis of the bearing journals 27; 28, and is arranged centrally on the transfer table. If the material roll 18 or 18' is in an oblique position, an axial offset "z" of the material roll can be determined as the transfer table 01 is being moved into the roll changer 15.

On one hand, the axial offset "z" can be determined through a determination of the position of the points M3 and M4, as depicted in FIG. 9, that actuate the respectively allocated laser sensors 44, 45. To accomplish this, a length measuring system 46, with an absolute scale, is positioned on the track 06. The length measuring system 46 determines the absolute position of the transfer table 01 on the track 06 as the point M3 passes through the laser sensor 44, and determines the position of the transfer table 01 on the track 06 as the point M4 passes through the laser sensor 45 which has respectively been allocated to it. From these two known measurements, the axial offset "z" over the entire length of the new material roll 18 is determined through the use of a differential formation. The axial offset "z" is then divided in half and the theoretical axle-loading position for the transfer table 01 is corrected by the amount "z"/2, so that, depending upon the amount of the axial offset, the transfer table is either moved "z"/2 further into the roll changer, or is stopped "z"/2 in front of it.

The axial offset "z" can also be determined by measuring the time interval between detection of the point M3 and of the point M4, and multiplying that determined time interval by a speed of movement of the transfer table.

With this preferred embodiment of the present invention, it can also be determined whether the material roll 18 or 18' is arranged with its longitudinal axis 19, 19' centered on the transfer table 01. The absolute position of the transfer table 01 in the theoretical axle-loading position, when the material roll 18, 18' is straight and centrally positioned, is known. If the roll lies on the transfer table in parallel offset, a parallel axial offset "v" must also be determined. To accomplish this determination, after the transfer table 01 has been moved into the theoretical axle-loading position for the new material roll 18, 18', the actual position of the transfer table 01 is determined by the length measuring system 46. If this deviates from the theoretical axle-loading position, the transfer table 01 must, in turn, be corrected by this amount "v".

The calculation of the deviation in position of the material roll 18, 18', both oblique position and additional axial offset, can be combined as the transfer table 01 is being moved into the roll changer 15.

Once the transfer table 01 has reached the corrected axle-loading position, the bearing journals 27, 28 are introduced into the core.

In one preferred embodiment of the present invention, the bearing journals 27, 28 have centering tips 47, as seen in FIG. 9, which centering tips 47 facilitate the introduction of the bearing journals 27, 28 into a core of an obliquely positioned roll such as a new material roll 18. As the bearing journals 27, 28 are being introduced into the core of the material roll 18, 18', the bearing ring 09 of the transfer table 01 is momentarily switched on, and the roll transport structure 03 is able to rotate to the necessary position as the bearing journals 27, 28 are being inserted into the core. The roll transport structure 03 is preferably connected to the transport carriage 02 via springs 48, such that, following the axle-loading process, the structure is rotated back to the starting position by the springs 48, which springs 48 are depicted schematically in FIG. 9.

If the determination of the axial offset "z" produces the result that the oblique position of the material roll 18, 18' is greater than a maximum catch range for the centering tips 47, an error signal is generated, and the axle-loading process is stopped. In this case, the material roll must either be repositioned on the transfer table, or the axle-loading process must be performed manually on the roll changer.

In FIG. 10, a preferred embodiment of a centering tip 47, for use in the present invention, is shown, and such as can be used on bearing journals 27, 28 or on the alignment cone 42. FIG. 10 *a*) shows a perspective view, FIG. 10 *b*) shows a view from below and FIG. 10 *c*) is a sectional representation that is taken along the line A-A in FIG. 10 *b*).

The centering tip 47 has a central bore hole 49 and also four continuous connecting bore holes 51. On an upper side 52 of the centering tip 47, and that faces the material roll, which is not specifically shown here, the centering tip 47 has a tapered surface shape 53 that extends to the peripheral edge of the centering tip 47. The angle $\alpha$ of this tapered shape 53, as seen in FIG. 10, in relation to the rotational axis of the bearing journals, preferably measures 35°.

The roll changer, in accordance with the present invention, is preferably arranged in a web-fed rotary printing press.

The processes of transporting the material roll into position and/or of orienting the roll and/or of loading the roll onto the axle are preferably implemented through the utilization of a shared control unit. This control unit, which is not specifically depicted, is preferably configured as a control panel of a printing press.

While preferred embodiments of methods and a device for orienting a material roll to be transported to a roll changer, in accordance with the present invention, have been set forth fully and completely hereinabove, it will be apparent to one of skill in the art that various changes in, for example, the particular material on the roll, the overall operation of the roll changer, and the like could be made without departing from the true spirit and scope of the present invention which is accordingly to be limited only by the scope of the appended claims.

What is claimed is:

1. A method of orienting a material roll being transported to a roll changer including:

providing a material roll having a material roll longitudinal axis;

providing a transfer table which is movable in a direction transverse to said material roll longitudinal axis into a roll transfer position between bearing journals of the roll changer;

providing a transport carriage and a roll transport structure forming said transfer table;

supporting said material roll on said transfer table for orienting said material roll transversely to, as well as along said longitudinal axis of said material roll;

providing a rotary drive on said transfer table;

moving said transfer table and said material roll transversely to said material roll longitudinal axis;

providing a roll diameter sensor;

using said roll diameter sensor for determining a diameter of said material roll;

providing material roll oblique position sensors;

determining an oblique position of said material roll on said transfer table using said material roll oblique position sensors;

using said rotary drive on said transfer table for pivoting said material roll and said roll transport structure about a vertical axis with respect to said transport carriage in response to said determining of said oblique position of said material roll for accomplishing an oblique positioning of said material roll on said transfer table;

determining a position of a first end surface of said material roll on said transfer table;

determining a position of a second end surface of said material roll on said transfer table;

providing roll support arms on said roll changer;

providing bearing journals on said roll support arms of said roll changer and having a rotational axis;

determining an axle-loading position for said roll support arms using said determined roll diameter;

positioning said roll support arms in said axle-loading position determined by said roll diameter;

establishing an axle-loading position for said transfer table using said roll diameter and said oblique position of said material roll;

moving said bearing journals of said roll support arms in a direction of said material roll longitudinal axis; and loading said material roll onto said bearing journals of said roll support arms in said established axle-loading position based on said oblique position of said roll on said transfer table, based on said roll diameter and based on said determined positions of said first and second end surfaces of said material roll.

2. The method of claim 1 further including providing one of said oblique position sensors as a first end surface sensor, using said first end surface sensor for emitting a first signal as said first end of said material roll is passing said first end surface sensor, providing another of said oblique position sensors as a second end surface sensor, using such second end surface sensor for emitting a second signal as said second end of said material roll is passing said second end surface sensor and determining said oblique position of said longitudinal axis of said material roll from said first and second signals from said first and second end surface sensors.

3. The method of claim 2 further including emitting said first and second signals in response to passage of a circumferential surface of said material roll past said first and second end surface sensors.

4. The method of claim 2 further including providing a material roll core and emitting said first and second signals in response to passage of said material roll core past said first and second end surface sensors.

5. The method of claim 2 further including using one of a position and a movement of said transfer table for determining said oblique position of said material roll.

6. The method of claim 2 further including determining a first position of said transfer table when said first end of said material roll is passing said first end surface sensor; determining a second position of said transfer table when said second end surface of said material roll is passing said second end surface sensor and using a difference in said first and second transfer table positions for determining one of said oblique position and an axial offset.

7. The method of claim 6 further including correcting a path of motion of said transfer table to compensate for said determined axial offset.

8. The method of claim 2 further including determining a time interval between said emitting of said first and second signals, determining a speed of said transfer table and determining said oblique position using said determined time interval and said transfer table speed.

9. The method of claim 1 further including aligning said longitudinal axis of said material roll with relation to a rotational axis of said bearing journals.

10. The method of claim 9 further including aligning said longitudinal axis parallel with said rotational axis.

11. The method of claim 1 further including varying an axial alignment of said material roll after said loading of said material roll onto said bearing journals.

12. The method of claim 1 further including identifying an offset of said material roll in a direction of said longitudinal axis of said material roll in relation to an optimum axle-loading position.

13. The method of claim 12 further including determining a parallel offset of said material roll transversely to said longitudinal axis.

14. The method of claim 1 further including moving said material roll in an axial direction of said material roll into a center position between said roll support arms of said roll changer.

15. The method of claim 1 further including determining said axle-loading position of said roll support arms of said roll changer based on said determined material roll diameter.

16. The method of claim 15 further including pivoting said roll support arms into said axle-loading position.

17. The method of claim 1 further including determining said axle-loading position of said transfer table based on said determined roll diameter.

18. The method of claim 1 further including pivoting said material roll for axially aligning said material roll.

19. The method of claim 1 further including providing a material roll core and introducing said bearing journals into said material roll core.

20. The method of claim 1 further including moving an axial alignment of said material roll in a horizontal direction.

21. The method of claim 20 further including providing a lifting device on said transfer table and using said lifting device for orienting said material roll in a horizontal direction.

22. The method of claim 1 further including determining a distance to a peripheral edge of said material roll with respect to said roll changer at least at first and second points spaced along said longitudinal axis of said material roll.

23. The method of claim 22 further including determining an axial offset of said material roll, with respect to a rotational axis between said bearing journals using said distances to said material roll peripheral edge.

24. The method of claim 22 further including determining said distances to said peripheral edge using contactless sensors.

25. The method of claim 1 further including pivoting said material roll about a horizontal axis and minimizing an axial offset of said material roll.

26. The method of claim 1 further including providing centering tips on said bearing journals and using said centering tips for correcting said oblique position of said material roll.

27. The method of claim 1 further including using said transport carriage for transporting said material roll to said axle-loading position.

28. A device adapted to orient a material roll to be loaded onto an axle in a roll changer comprising:

a transfer table including a transport carriage having a transport rail and a roll transport structure movably supported on said transport rail of said transport carriage, said roll transport structure being configured to support a material roll to be loaded onto an axle in a roll changer;

means supporting said transfer table for movement of said transfer table and the supported material roll transversely to a longitudinal axis of the material roll and for movement toward said roll changer and into a position between first and second bearing journals of the roll changer to transport the material roll into a roll transfer position between said first and second bearing journals of the roll changer;

means displacing said roll transport structure on said transport carriage of said transfer table for movement of said material roll along said longitudinal axis;

means to detect a position of said material roll on said roll transport structure of said transfer table in said longitudinal direction of said material roll and to detect an oblique position of said material roll on said roll transport structure of said transfer table in said direction transverse to said longitudinal axis of the material roll;

a bearing ring configured as a circular rolling-contact bearing and supporting said transport rail of said transport carriage for pivotal movement of said roll transport structure with respect to said transport carriage about a vertical pivot axis in response to the detection of an oblique position of said material roll on said roll transport structure and a bearing ring drive motor on said transport carriage for rotation of said circular rolling-contact bearing about said vertical pivot axis in response to said detection of an oblique position of said material roll.

29. The device of claim 28 wherein said transport carriage is supported for movement transversely to said longitudinal axis of the material roll and said roll transport structure is supported for displacement on said transport carriage in a longitudinal direction of said material roll and is rotatable with respect to said transport carriage.

30. The device of claim 28 further including a lifting device on said transfer table and adapted to pivot the material roll about said longitudinal axis.

31. The device of claim 28 wherein said means to detect a position of said material roll are sensors on the roll changer to determine a distance between a fixed point on the roll changer and a peripheral edge of said material roll.

32. The device of claim 28 wherein said means to detect a position of said material roll are sensors on the roll changer to determine a distance between a fixed point on the roll changer and an end surface on said material roll.

33. The device of claim 28 wherein said means to detect a position of said material roll are sensors on the roll changer and wherein said material roll includes a roll core, said sensors determining differences in position of two end surfaces of said material roll core.

34. The device of claim 28 further wherein said means to detect a position of said material roll are sensors on the roll changer and further including a measuring system to determine a position of said transport carriage in relation to one of an axial offset and a parallel offset of said material roll.

35. The device of claim 28 further wherein said means to detect a position of said material roll are sensors which emit a signal as said material roll is moved into the roll changer.

36. The device of claim 28 further including means adapted to minimize an edge offset of said material roll with respect to a trailing material web of an expiring material roll.

37. The device of claim 28 wherein a first one of said means to detect a position of said material roll is a first sensor usable to determine a distance of an outer end of an end surface of said material roll from a fixed point.

38. The device of claim 37 further wherein said determined distance is measured using optical distance measurement.

39. The device of claim 38 wherein said first sensor includes an illumination source and a radiation-sensitive receiver.

40. The device of claim 37 wherein said first sensor is mounted to be displaceable in a radial direction of a roll support arm of the roll changer.

41. The device of claim 40 wherein said first sensor is usable with a material roll diameter detection device and is displaceable in said radial direction as a function of said material roll diameter.

42. The device of claim 28 further including material roll alignment devices.

43. The device of claim 42 wherein said material roll alignment devices are alignment cones.

44. The device of claim 42 wherein said material roll alignment devices are positioned adjacent said bearing journals.

45. The device of claim 44 wherein a position of said alignment elements, with respect to said bearing journal can be altered.

46. The device of claim 28 further including centering tips on said bearing journals.

47. The device of claim 28 wherein said bearing ring drive motor is an electric motor.

* * * * *